US008777401B2

(12) United States Patent
Matsui

(10) Patent No.: US 8,777,401 B2
(45) Date of Patent: Jul. 15, 2014

(54) RECORDING MEDIUM TRANSFER APPARATUS AND IMAGE FORMING APPARATUS

(75) Inventor: Yasuhiro Matsui, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/982,895

(22) PCT Filed: Nov. 30, 2011

(86) PCT No.: PCT/JP2011/077604
§ 371 (c)(1),
(2), (4) Date: Jul. 31, 2013

(87) PCT Pub. No.: WO2012/114594
PCT Pub. Date: Aug. 30, 2012

(65) Prior Publication Data

US 2013/0314484 A1 Nov. 28, 2013

(30) Foreign Application Priority Data

Feb. 24, 2011 (JP) ..... 2011-037792

(51) Int. Cl.
*B41J 2/01* (2006.01)

(52) U.S. Cl.
USPC ..... 347/104; 347/16; 347/101; 198/810.03

(58) Field of Classification Search
USPC ..... 347/104, 101, 16; 198/810.03
See application file for complete search history.

(56) References Cited

FOREIGN PATENT DOCUMENTS

| | | | |
|---|---|---|---|
| JP | 6-56292 | A | 3/1994 |
| JP | 11-334160 | A | 12/1997 |
| JP | 2000-118812 | A | 4/2000 |
| JP | 2009-239011 | A | 10/2009 |
| JP | 4449924 | B2 | 2/2010 |

OTHER PUBLICATIONS

International Preliminary Report on Patentability with Written Opinion in Japanese and in English (8 pages).
International Search Report and Written Opinion of PCT/JP2011/077604 dated Feb. 28, 2012.

*Primary Examiner* — Henok Legesse
(74) *Attorney, Agent, or Firm* — Lucas & Mercanti, LLP

(57) ABSTRACT

A recording medium transfer apparatus is provided with: an endless belt; a plurality of transfer rollers, which intermittently rotate the endless belt; a slide unit, which can freely move back and forth between the initial position and the end position of the endless belt; a driving device, which returns the slide unit to the initial position from the end position; a linear encoder, which detects a transfer amount of the slide unit; a calculation unit, which calculates a transfer amount of the recording medium on the basis of the detection results obtained from the linear encoder; and a control unit, which controls the transfer amount of the recording medium on the basis of the transfer amount. The slide unit engages with the endless belt at the initial position before the endless belt rotationally moves, then, moves with the rotational movement of the endless belt, and when the slide unit reaches the end position, the slide unit releases the engagement with the endless belt, and returns to the initial position by means of the driving device when the endless belt is stopped. The calculation unit calculates the transfer amount of the recording medium on the basis of the detection results obtained from the linear encoder, the detection results being the transfer amount of the slide unit from the initial position to the end position.

7 Claims, 8 Drawing Sheets

RECORDING MEDIUM TRANSFER APPARATUS AND IMAGE FORMING APPARATUS

CROSS-REFERENCE TO RELATED APPLICATION

This application is a 371 of PCT/JP2011/077604, filed Nov. 30, 2011, which claims the benefit of Japanese Patent Application No. 2011-037792, filed Aug. 24, 2011, the contents of each of which are incorporated herein by reference.

TECHNICAL FIELD

The present invention relates to a recording medium transfer apparatus and an image forming apparatus.

BACKGROUND ART

Conventionally, image forming apparatuses such as inkjet recording apparatuses, for example, are known, in each of which a sheet-shaped recording medium is placed on an endless belt and the recording medium is transferred by rotating the endless belt. Such recording medium transfer apparatuses have encoders provided on the rotation axes of the driving rollers which drive the endless belts to control their transfer amount by the number of pulses.
(For example, see Patent Document 1).

PRIOR ART DOCUMENT

Patent Document

Patent Document 1: Japanese Patent No. 4449924

SUMMARY OF THE INVENTION

Problem to be Solved by the Invention

In the above recording medium transfer apparatuses, there is a possibility that the accurate transfer amount cannot be measured due to causes such as eccentricity of the driving rollers, eccentricity of the encoders, variation in thickness of the endless belts and the like. Especially, if the transfer distance is to be long, errors in the measurement results are to be large.

An object of the present invention is to accurately measure the transfer amount of a recording medium regardless of the transfer distance.

Means for Solving the Problem

A recording medium transfer apparatus of claim 1 includes an endless belt wherein a recording medium is places on a surface thereof, a plurality of transfer rollers which support the endless belt so that a part of the endless belt is to be flat and intermittently rotate the endless belt, a slide unit which freely moves back and forth between an initial position of a path which is the part of the endless belt that is flat and an end position that is at a downstream side in a rotational direction of the endless belt than the initial position, a driving device which returns the slide unit to the initial position from the end position, a linear encoder which detects a transfer amount of the slide unit, a calculation unit which calculates a transfer amount of the recoding medium from a detection result obtained by the linear encoder, and a control unit which controls a transfer amount of the recording medium to be transferred by the transfer rollers according to the calculated transfer amount, and the slide unit engages with the part of the endless belt that is flat at the initial position before rotational movement of the endless belt starts, moves following the rotational movement of the endless belt, releases an engagement with the endless belt when reaching the end position and is returned to the initial position by the driving device when the endless belt is at a stop after the engagement is released, and the calculation unit calculates the transfer amount of the recording medium according to the detection result obtained by the linear encoder during a movement of the slide unit reaching the end position from the initial position.

According to the invention of claim 2, the recording medium transfer apparatus of claim 1 further includes a guide axis which extends along a part of the path which is the part of the endless belt that is flat and guides the slide unit, and the slide unit contacts with and separates from the endless belt by rotating with respect to the guide axis.

According to the invention of claim 3, in the recording medium transfer apparatus of claim 1 or 2, the slide unit includes a nub formed on a contact face which contacts with the endless belt.

According to the invention of claim 4, in the recording medium transfer apparatus of any one of claims 1 to 3, the slide unit releases the engagement with the endless belt when the slide unit reaches the end position in a case where the endless belt rotates continuously.

According to the invention of claim 5, in the recording medium transfer apparatus of any one of claims 1 to 4, the slide unit includes a lever member which is pivotally supported so as to rotate freely and a roller which is pivotally supported at a lower end of the lever member so as to rotate freely, and an upper end of the lever member rotates by being pushed by a movable unit of the driving device when the driving device returns the slide unit to the initial position from the end position and makes the slide unit rise by pressing the surface of the endless belt with the roller to release the engagement between the endless belt and the slide unit.

According to the invention of claim 6, in the recording medium transfer apparatus of any one of claims 1 to 4, a movable unit of the driving device includes a cam face which makes the slide unit rise to release the engagement between the endless belt and the slide unit when the driving device returns the slide unit to the initial position from the end position.

An image forming apparatus of claim 7 includes the recording medium transfer apparatus of any one of claims 1 to 6 and an image forming unit which forms an image on the recording medium which is transferred by the recording medium transfer apparatus.

Advantageous Effect of the Invention

According to the present invention, the transfer amount of a recording medium can be measured accurately regardless of the transfer distance.

EMBODIMENT FOR CARRYING OUT THE INVENTION

Figure 1:
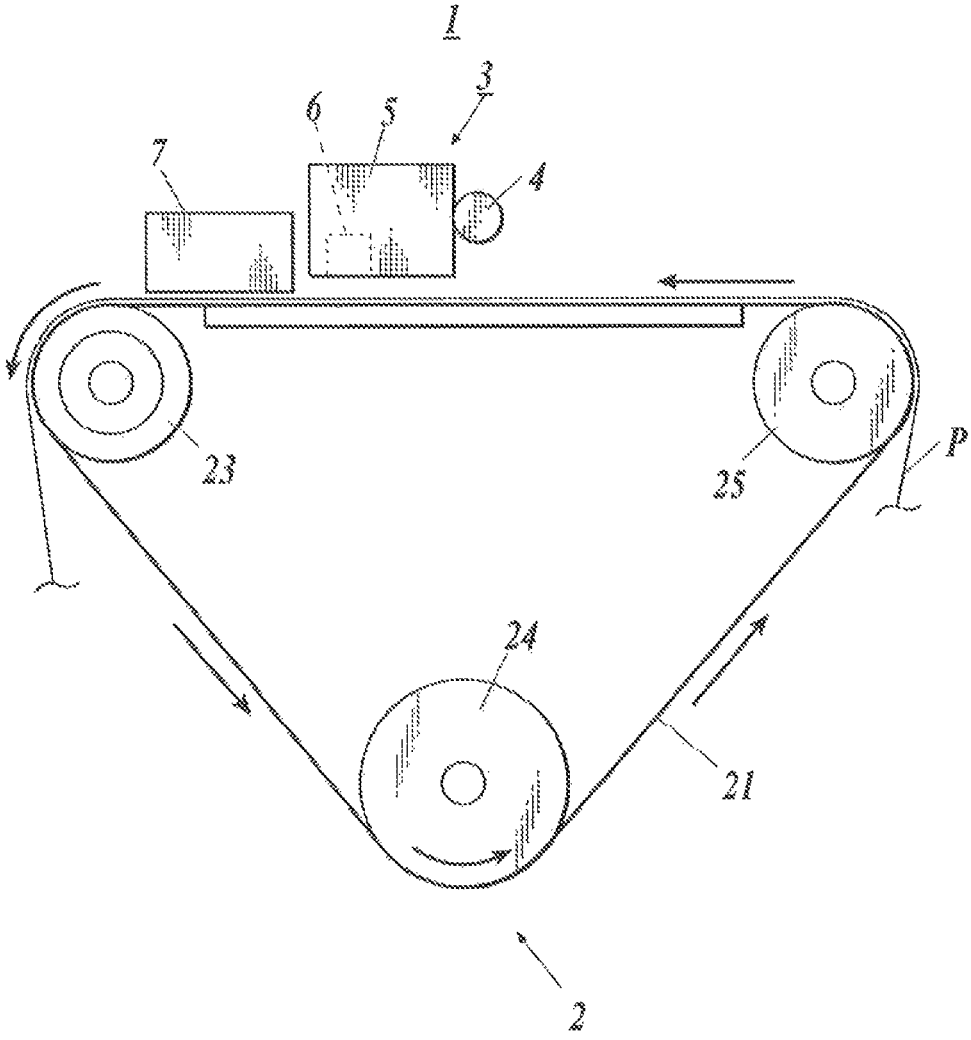
FIG. 1 This is a schematic view showing an inner configuration of an inkjet recording apparatus of the embodiment.

Hereinafter, the best mode for carrying out the present invention will be described with reference to the drawings. Although various limitations which are technically preferable for carrying out the present invention are included in the embodiment, scope of the invention is not limited to the following embodiment and the examples shown in the drawings.

FIG. 1 is a schematic diagram of an inkjet recording apparatus as an image forming apparatus according to the present invention. As shown in FIG. 1, the inkjet recording apparatus 1 includes a recording medium transfer apparatus 2 which transfers a sheet-shaped recording medium P and an image forming unit 3 which forms an image on the recording medium P which is transferred by the recording medium transfer apparatus 2.

The image forming unit 3 includes a bar-shaped carriage rail 4 which is disposed in a horizontal direction. A carriage 5 which is driven by the carriage driving mechanism (not shown) is supported by the carriage rail 4 so as to freely move back and forth in the directions along the carriage rail 4 (hereinafter, referred to as the main scanning direction).

In the carriage 5, recording heads 6 which discharge ink to the recording medium P placed below are installed. As for the recording heads 6, for example, eight or sixteen recording heads 6 are installed so as to correspond with an ink set including yellow (Y) magenta (M), cyan (C) and black (K) or with this ink set and a set of light YMCK. Further, although not shown in the drawings, sub ink tanks are installed in the carriage 5 for pooling various colors of inks which are to be supplied to their respective recording heads 6. The sub ink tanks are respectively joined with ink supplying tubes which are connected to the ink tanks pooling various colors of inks. Inks are supplied appropriately to the sub ink tanks from the ink tanks through the ink supplying tubes.

The recording heads 6 are configured to perform image forming by discharging various colors of inks to the recording medium P while scanning in the main scanning direction according to the back and forth movement of the carriage 5 along the carriage rail 4. At this time, in the embodiment, each recording head 6 discharges ink during both scanning in the forward direction and backward direction to perform inkjet recording.

Below the image forming unit 3 of the inkjet recording apparatus 1, a recording medium transfer apparatus 2 is disposed. The transfer apparatus 2 includes an endless belt 21 which transfers the recording medium P in the direction that is orthogonal to the main scanning direction (hereinafter, referred to as the sub scanning direction) in a state where the recording medium P facing the nozzle faces of the recording heads 6. Further, the transfer apparatus 2 includes a plurality of transfer rollers 23, 24 and 25 for rotating the endless belt 21. Among the transfer rollers 23, 24 and 25, the one transfer roller 23 is the driving roller and the other two transfer rollers 24 and 25 are the following rollers. The endless belt 21 is bridged around the transfer rollers 23, 24 and 25. A part of the bridged endless belt 21 is a horizontal flat surface which is parallel with the nozzle faces of the recording heads 6. The recording medium P is to be placed on the horizontal flat surface.

Figure 2:
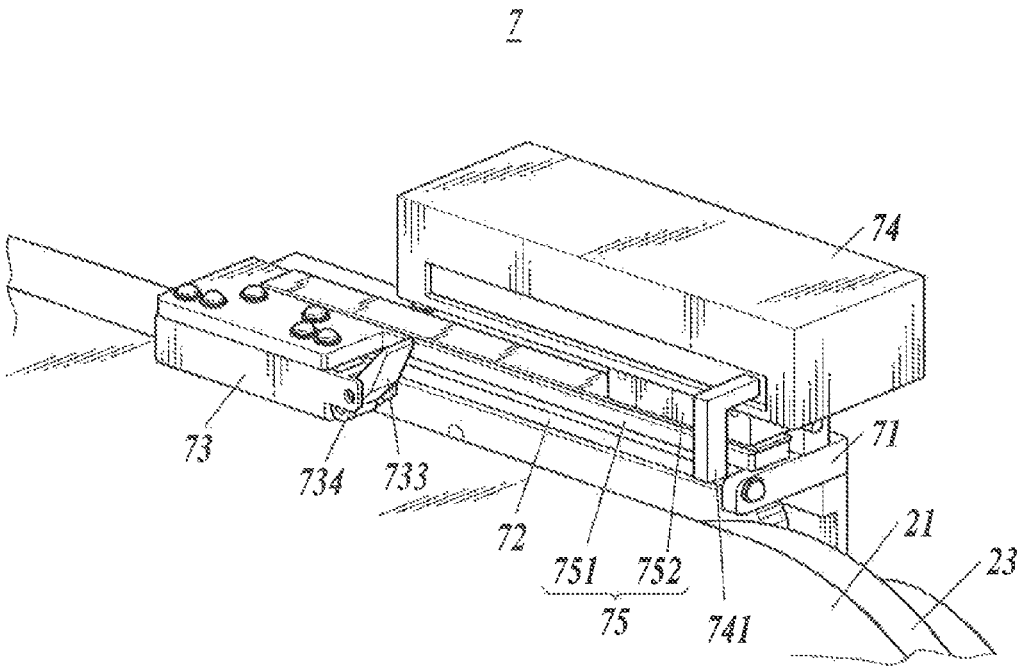
FIG. 2 This is a schematic view showing an outline configuration of a transfer amount measuring unit provided in the inkjet recording apparatus of FIG. 1.
Figure 3:
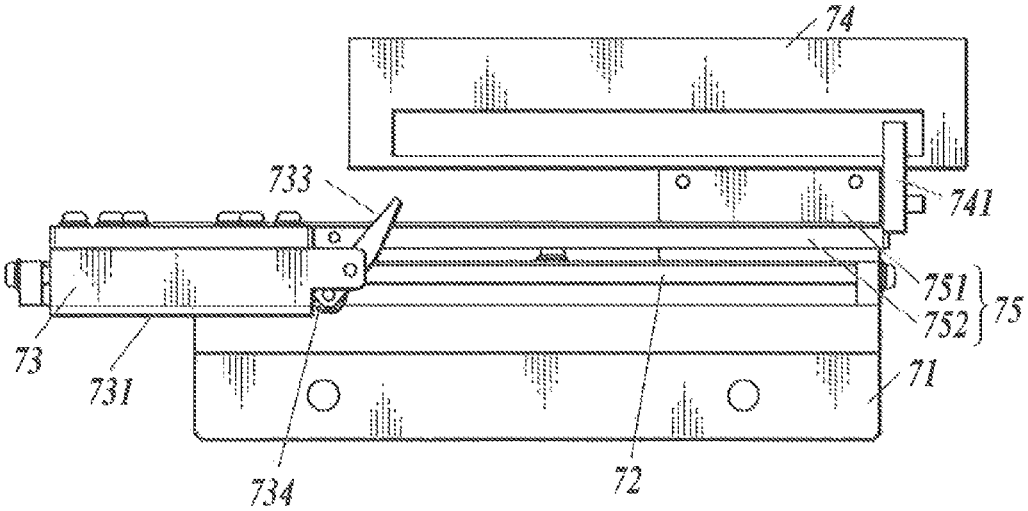
FIG. 3 This is a side view showing an outline configuration of the transfer amount measuring unit of FIG. 2.

Moreover, the recording medium transfer apparatus 2 includes a transfer amount measuring unit 7 for calculating the transfer amount of the recording medium P. FIG. 2 is a schematic view showing an outline configuration of the transfer amount measuring unit 7. FIG. 3 is a side view of the transfer amount measuring unit 7 and FIG. 4 is a back view of the transfer amount measuring unit 7.

Figure 4:
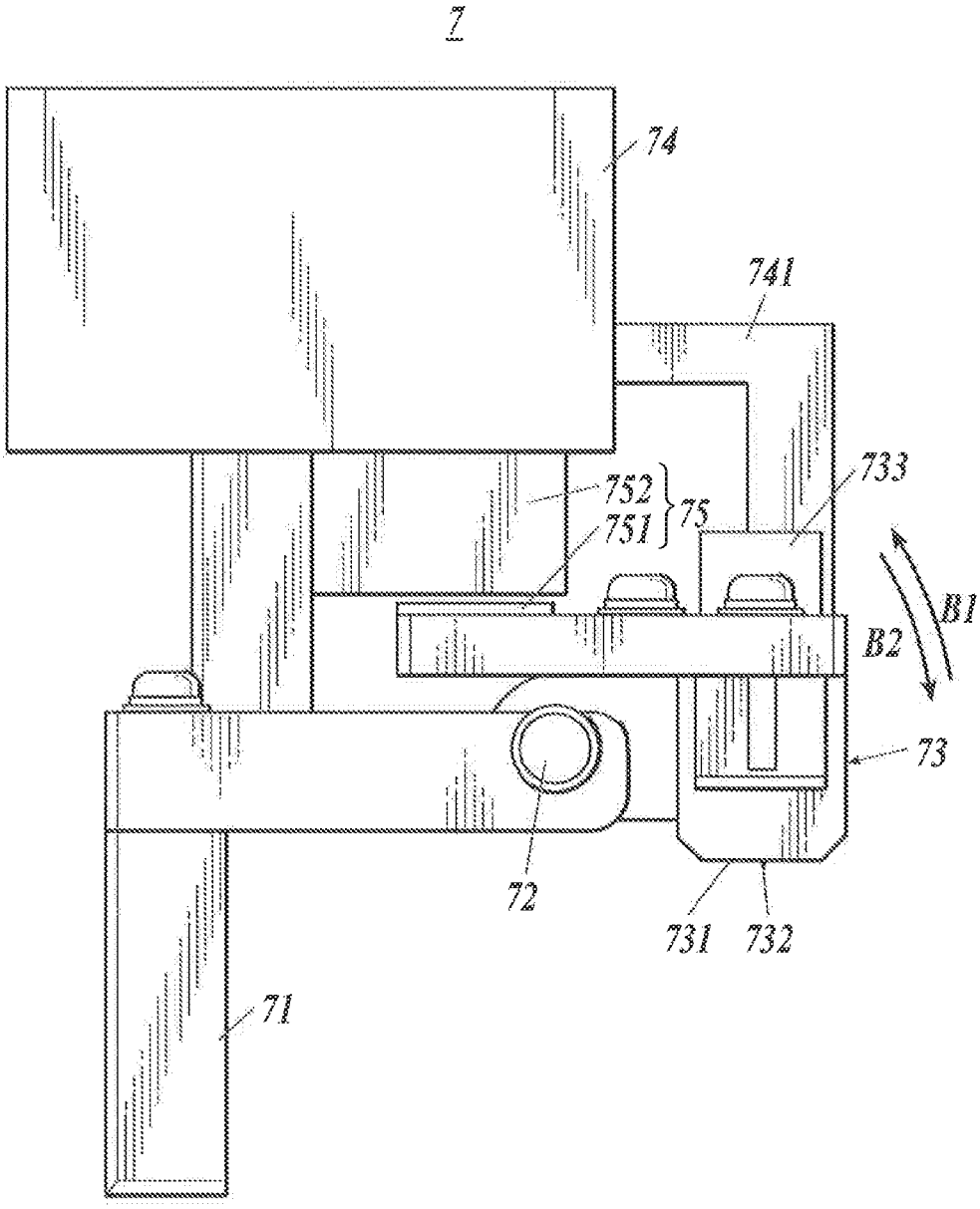
FIG. 4 This is a back view showing an outline configuration of the transfer amount measuring unit of FIG. 2.

As shown in FIGS. 2 to 4, the transfer amount measuring unit 7 includes a support 71, a guide axis 72, a slide unit 73, a driving device 74 and a linear encoder 75.

The support 71 is disposed near the edge of the part of the endless belt 21 that is horizontally flat and more in the downstream side in the rotational direction than the carriage rail 4. The support 71 is fixed in the inkjet recording apparatus 1 so that the relative positional relation between the support and the carriage rail 4 does not change.

The guide axis 72 is a rod material and is supported by the support 71. The guide axis 72 extends along the path which is the horizontally flat part of the endless belt 21.

The slide unit 73 is engaged with the guide axis 72 and the slide unit 73 is guided freely back and forth by the guide axis 72. The moving range of the slide unit 73 is from the upper stream end to the lower stream end in the rotational direction of the guide axis 72. The uppermost point in the upstream side is the initial position and the lowermost point in the downstream side is the end position.

The lower surface of the slide unit 73 is the contact face 731 which contacts with the periphery section of the endless belt 21. The recording medium P is not placed at the part where the endless belt 21 contacts with the contact face 731. A nub 732 which protrudes downward is provided on the contact face 731. By the slide unit 73 rotating around the guide axis 72 as the rotation axis, contacting and separation between the contact face 731 and the endless belt 21 is switched. If the contact face 731 is in a state of contacting the endless belt 21, the slide unit 73 slides with the rotational movement of the endless belt 21.

Further, at the tip of the slide unit 73 in the rotational direction, a lever member 733 which is supported so as to rotate freely is provided along the rotational direction. A roller 734 is pivotally supported at the lower end of the lever member 733 so as to rotate freely.

Figure 5:
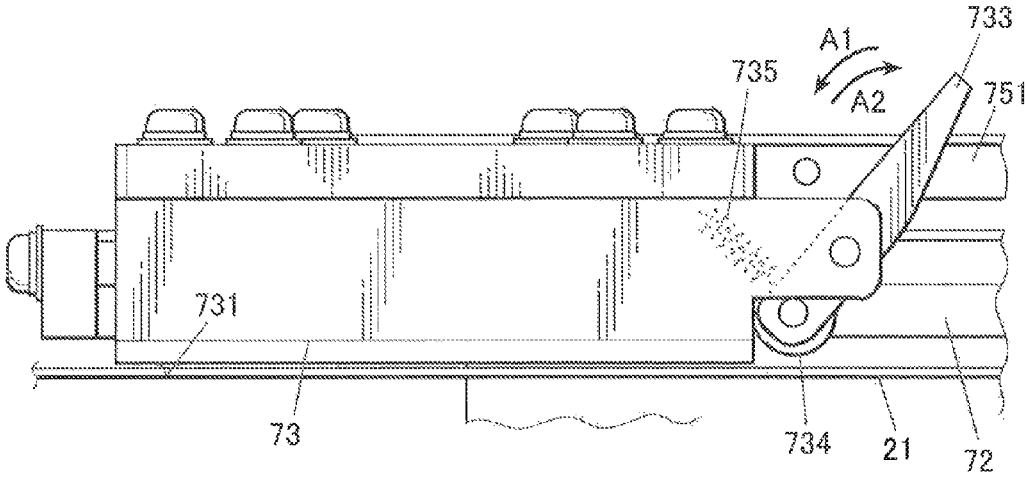
FIG. 5 This is an enlarged view showing an outline configuration of a slide unit provided in the transfer amount measuring unit of FIG. 3.

FIG. 5 is an enlarged view of the slide unit 73. As shown in FIG. 5, a spring member 735 which urges the lever member 733 so that the roller 734 separates from the endless belt 21 is provided inside the slide unit 73. The state where the roller 734 is separated from the endless belt 21 is the state where the contact face 731 contacts with the endless belt 21.

Figure 6:
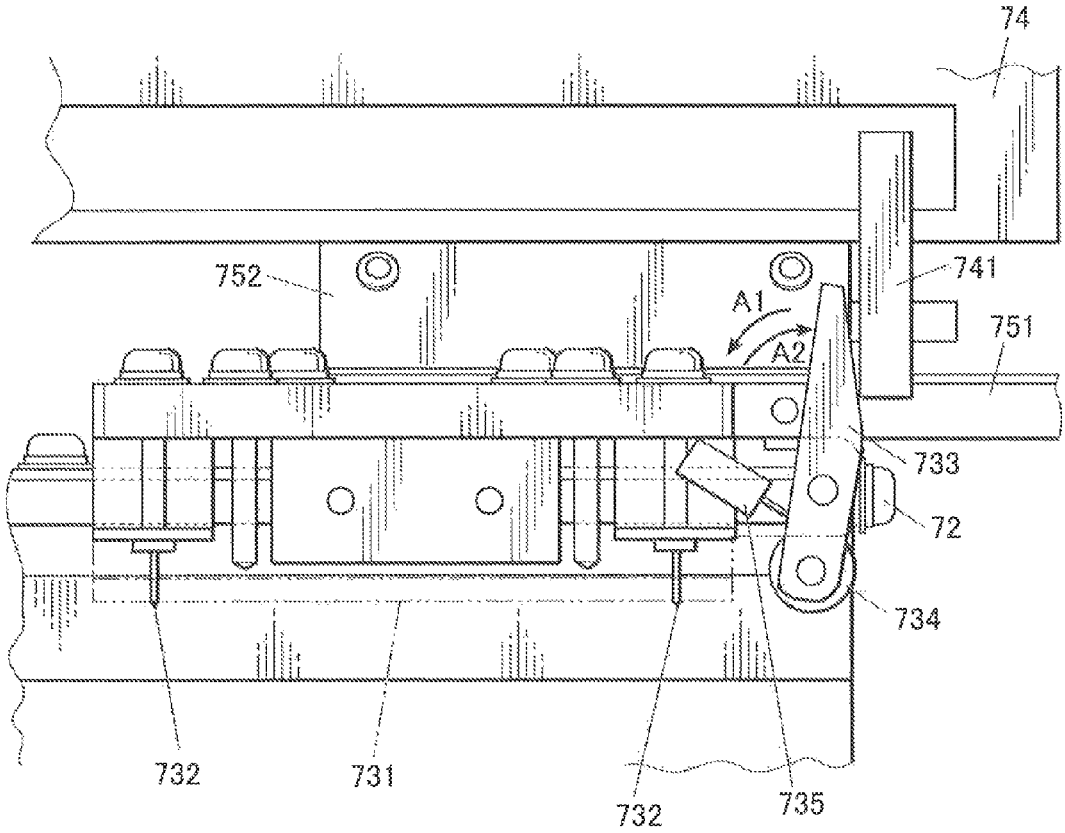
FIG. 6 This is an explanatory diagram showing a state where the engagement of the slide unit provided in the transfer amount measuring unit of FIG. 3 with the endless belt is released.
Figure 7:
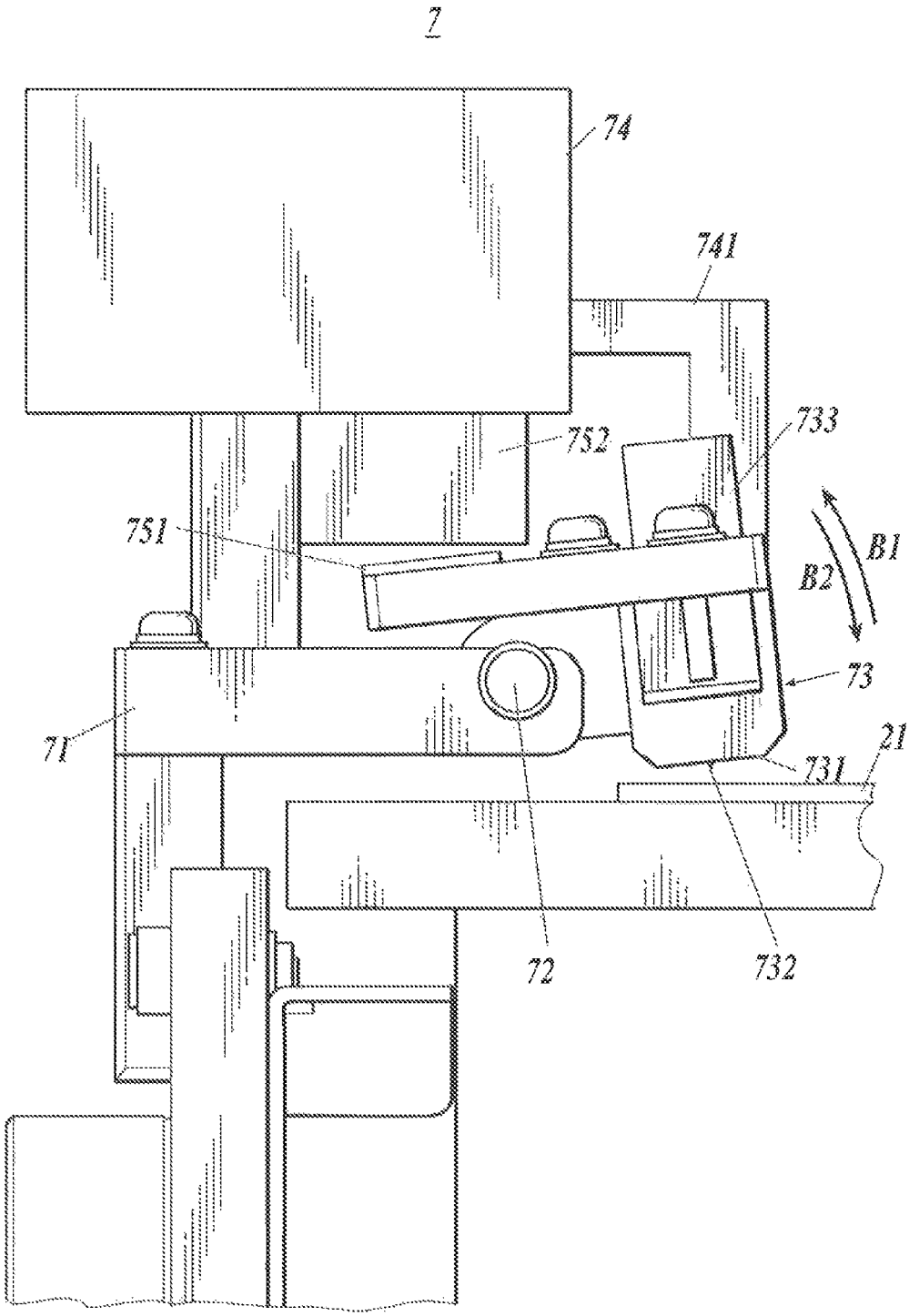
FIG. 7 This is a back view of the slide unit of FIG. 6.

As shown in FIG. 6, the lever member 733 rotates in the direction of arrow A1 when the upper end of the lever member 733 is pushed by the movable unit 741 of the driving device 74. When the roller 734 presses the surface of the endless belt 21 due to such rotation, the slide unit 73 rotates in the direction of arrow B1 centering around the guide axis 72 and the contact face 731 rises as shown in FIG. 7. In such way, the contact face 731 separates from the endless belt 21.

Further, when the movable unit 741 of the driving device 74 separates from the upper end of the lever member 733, the lever member 733 rotates as the arrow A2 by the urging force of the spring member 735 as shown in FIG. 5. When the roller 734 separates from the endless belt 21 due to such rotation, the slide unit 73 rotates in the direction of arrow E2 centering around the guide axis 72 and the contact face 731 lowers as shown in FIG. 4. In such way, the contact face 731 contacts with the endless belt 21.

As shown in FIG. 2, the driving device 74 is for returning the slide unit 73 to the initial position from the end position and the driving device 74 is disposed on the support 71. The driving device 74 is provided with the movable unit 741 which moves back and forth along the path which is the part of the endless belt 21 that is horizontally flat. By the movable unit 741 engaging with the lever member 733 of the slide unit 73 to push the lever member 733 in the upper stream side in the rotational direction, the slide unit 73 returns to the initial position from the end position. After the returning, the movable unit 741 separates from the lever member 733 and moves to the downstream side in the rotational direction.

The linear encoder 75 includes a scale unit 751 and a sensor unit 752 which detects the transfer amount of the scale unit 751. The scale unit 751 is fixed integrally to the slide unit 73 and slides with the moving of the slide unit 73. The sensor unit 752 is fixed at the fore-end section of the slide unit 73 in the rotational direction.

Figure 8:
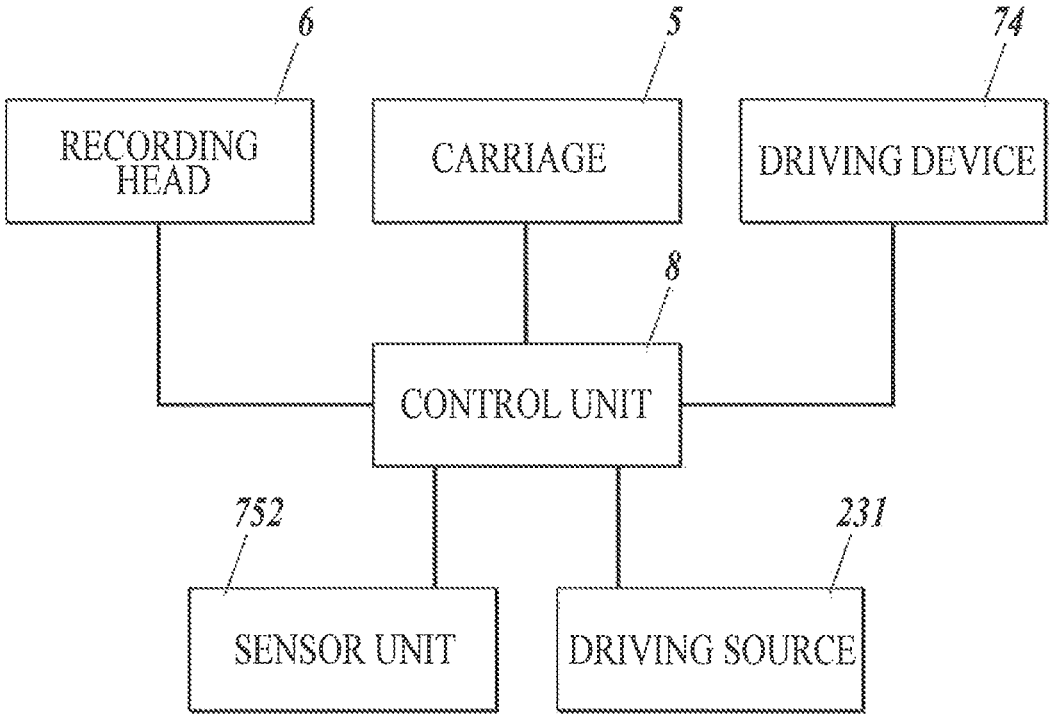
FIG. 8 This is a block diagram showing a main control configuration of the inkjet recording apparatus 1 of FIG. 1.

FIG. 8 is a block diagram showing the main control configuration of the inkjet recording apparatus 1. As shown in FIG. 8, the recording heads 6, the carriage 5 the driving device 74, the sensor unit 752 of the linear encoder 75, the driving source 231 of the transfer roller 23 and the like are electrically connected to the control unit 8 of the inkjet recording apparatus 1.

The control unit 8 is configured of a CPU (Central Processing Unit) and a memory, and controls each constituent part of the inkjet recording apparatus 1. The memory stores data of an image to be formed on the recording medium P and programs for controlling each constituent part of the inkjet recording apparatus 1. The CPU performs processing based on the data of an image and the programs stored in the memory and sends control signals to the constituent parts on the basis of the processing results.

Moreover, the control unit 8 calculates the transfer amount of the recording medium P from the detection results obtained by the sensor unit 752. In particular, the control unit 8 calculates the transfer amount of the recording medium P on the basis of the detection results obtained by the sensor unit 752 while the slide unit 73 moves to the end position from the initial position. During the slide unit 73's movement to the end position from the initial position, the slide unit 73 may move slightly backward while moving forward. The control unit 8 calculates the accurate transfer amount by subtracting the amount of moving backward. The control unit 8 is the calculation unit according to the present invention. Further, the control unit 8 controls the rotation amount of the transfer roller 23 based on the calculated transfer amount and controls the transfer amount of the recording medium P.

Next, operation of the embodiment will be described.

At the timing of image recording, the control unit 8 controls the driving source 231 of the transfer roller 23 so that the recording medium P is transferred intermittently. When the recording medium P stops while being transferred intermittently, the control unit 8 controls the carriage 5 and makes the recording heads 6 scan over the recording medium P. During the scanning by the carriage 5, the control unit 8 controls the recording heads 6 so that inks are to be discharged respectively from the recording heads 6 and records an image on the recording medium P.

Here, when the recording medium P is being transferred, the control unit 8 calculates the transfer amount thereof. In particular, the slide unit 73 is engaged with the flat part of the endless belt 21 at the initial position as shown in FIG. 2 before the recording medium P is transferred, that is, before the rotational movement of the endless belt 21 starts. When the endless belt 21 starts its rotational movement to transfer the recording medium P, the slide unit 73 moves following the rotational movement of the endless belt 21. Due to such movement, the scale unit 751 of the linear encoder 75 also moves, and the transfer amount thereof is detected by the sensor unit 752. Here, at the moment when the endless belt 21 vibrates due to expansion and contraction thereof during the rotational movement, the endless belt 21 may move backward slightly. The slide unit 73 also follows this backward movement of the endless belt 21; therefore, the control unit 8 can also recognize the transfer amount of the backward movement. The control unit 8 subtracts the transfer amount of the backward movement and calculates the accurate transfer amount.

Figure 9:
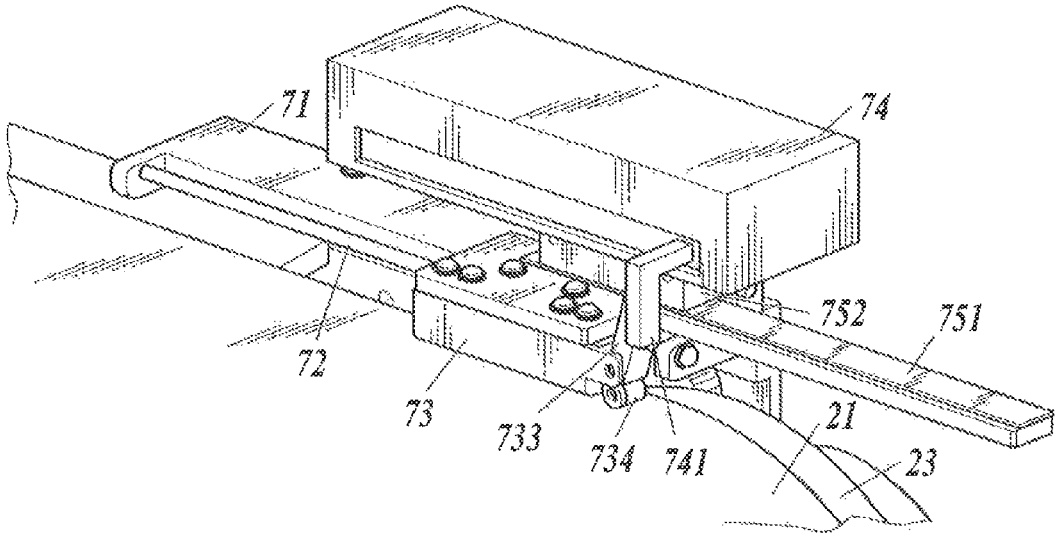
FIG. 9 This is a schematic view showing a state when the slide unit of FIG. 2 reached the end position.

As shown in FIG. 9, when the slide unit 73 reaches the end position by being transferred, the upper end of the lever member 733 is pushed by the movable unit 741 of the driving device 74 and the engagement between the slide unit 73 and the endless 91 is released.

Figure 10:
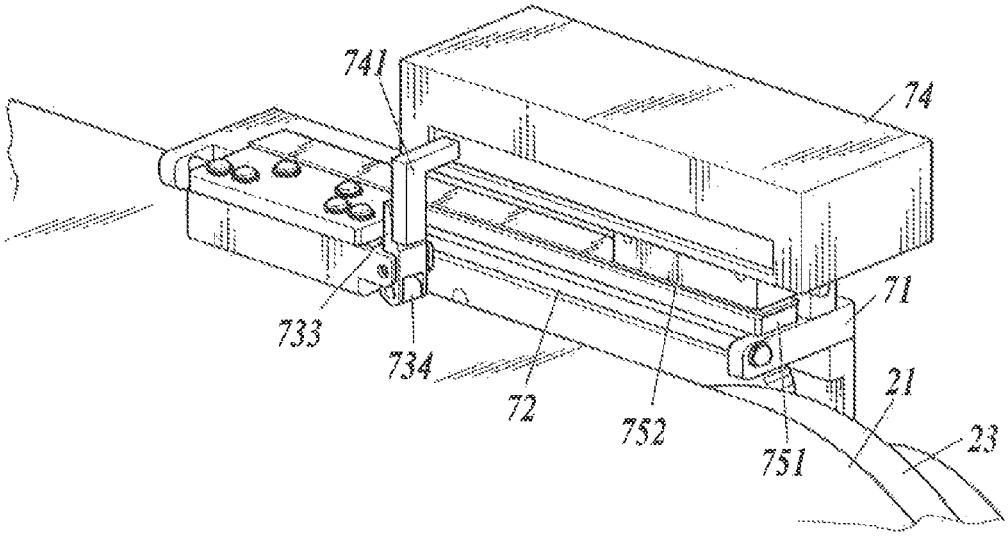
FIG. 10 This is a schematic view showing a state when the slide unit of FIG. 2 returned to the initial position.

After the engagement is released, while the endless belt 21 is at a stop, the moveable unit 741 moves toward the upper stream in the rotational direction. Therefore, the slide unit 73 returns to the initial position as shown in FIG. 10. At this time, the scale unit 751 of the linear encoder 75 also moves. However, the control unit 8 ignores the detection result obtained by the sensor unit 752 relating to such moving of the scale unit 751. That is the control unit 8 calculates the transfer amount of the recording medium on the basis of the detection results obtained by the sensor unit 752 during the movement of the slide unit 73 reaching the end position from the initial position. Then, the control unit 8 controls the rotation amount of the transfer roller 23 based on the calculated transfer amount and controls the transfer amount of the recording medium P.

At the time of continuous transferring of the recording medium P other than image forming and at the time of continuous rotation of the endless belt 21 when the recording medium P is not placed thereon, if the slide unit 73 reaches the end position due to such movements, the upper end of the lever member 733 is pushed by the moveable unit 741 of the driving device 74 and the engagement between the slide unit 73 and the endless belt 21 is released. In such way, even at the time other than image forming, the slide unit 73 can be prevented from restricting the rotation of the endless belt 21.

According to the embodiment as described above, the transfer amount of the recording medium P is calculated on the basis of the detection results obtained by the linear encoder 75 during the movement, of the slide unit 73 reaching the end position from the initial position by the slide unit 73, after engaging with the endless belt 21 at the initial position before the rotational movement of the endless belt 21, following the rotational movement of the endless belt 21. Therefore, even if the endless belt 21 moves backward due to its vibration, such backward movement can be subtracted and the accurate transfer amount can be calculated. Further, the control unit 8 controls the rotation amount of the transfer roller 23 based on the calculated transfer amount to control the transfer amount of the recording medium P. Therefore, the recording medium P can be transferred accurately.

Moreover, because the transfer amount is detected by the linear encoder 75, conventional influences of eccentricity of the driving roller, eccentricity of the encoder, variation in thickness of the endless belt and the like can be inhibited.

Due to the above, influence of errors in the measurement results can be small even when the transfer distance is long and the transfer amount of the recording medium P can be measured accurately.

By the slide unit 73 rotating with respect to the guide axis 72, the slide unit 73 contacts and separates with respect to the endless belt 21. Therefore, the sliding operation and the contacting and separating operation can be performed via the guide axis 72 and increase in the number of components can be suppressed.

Further, because the nub 732 is formed on the contact face 731 which contacts with the endless belt 21, the engagement between the endless belt 21 and the contact face 731 can be assured.

The present invention is not limited to the above described embodiment and can be arbitrarily modified. In the following description, same reference numerals are used for the parts similar to those in the above embodiment and the descriptions are omitted.

Figure 11:
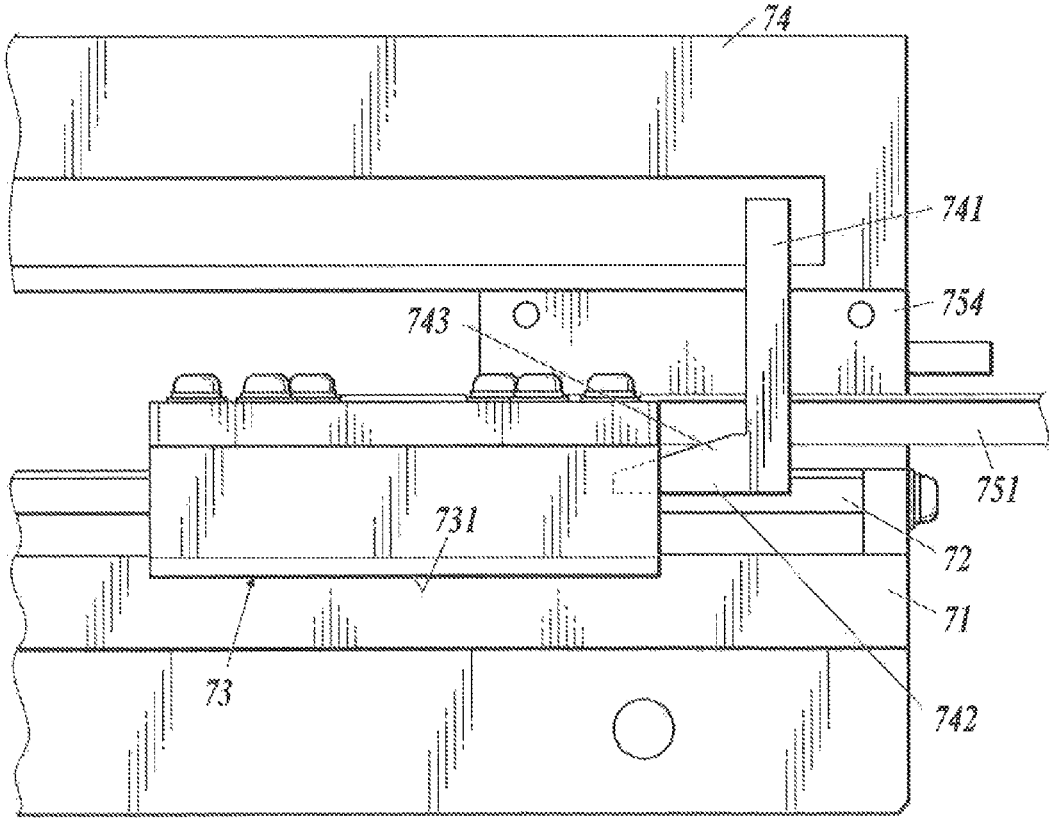
FIG. 11 This is a side view showing a modified example of the slide unit of FIG. 2.

For example, a case where the engagement between the slide unit 73 and the endless belt 21 is released by the lever member 733 and the roller 734 is shown as an example in the above embodiment. However, the engagement between the slide unit 73 and the endless belt 21 can be released by other configuration. For example, as shown in FIG. 11, an extending unit 742 which extends toward the downstream in the rotational direction is provided at the lower end of the movable unit 741, and the upper surface of the extending unit 742 is set as a cam face 743 that declines toward the upper stream side. When the slide unit 73 comes near the end position, the slide unit 73 engages with the cam face 743, and by being guided by the cam face 743, the slide unit 73 rises with its sliding movement. In such way, the contact face 731 separates from the endless belt 21 and the engagement between the slide unit 73 and the endless belt 31 is released.

EXPLANATION OF REFERENCE NUMERALS

1 inkjet recording apparatus (image forming apparatus)
2 recording medium transfer apparatus
3 image forming unit
4 carriage rail
5 carriage
6 recording head
7 transfer amount measuring unit
8 control unit (calculation unit)
21 endless belt
23, 24, 25 transfer roller
71 support
72 guide axis
73 slide unit
74, driving device
75 linear encoder
231 driving source
731 contact face
732 nub
733 lever member
734 roller
735 spring member
741 movable unit
742 extending unit
743 cam face
751 scale unit
752 sensor unit
P recording medium

The invention claimed is:

1. A recording medium transfer apparatus, comprising:

an endless belt wherein a recording medium is places on a surface thereof;

a plurality of transfer rollers which support the endless belt so that a part of the endless belt is to be flat and intermittently rotate the endless belt;

a slide unit which freely moves back and forth between an initial position of a path which is the part of the endless belt that is flat and an end position that is at a downstream side in a rotational direction of the endless belt than the initial position;

a driving device which returns the slide unit to the initial position from the end position;

a linear encoder which detects a transfer amount of the slide unit;

a calculation unit which calculates a transfer amount of the recoding medium from a detection result obtained by the linear encoder; and a control unit which controls a transfer amount of the recording medium to be transferred by the transfer rollers according to the calculated transfer amount, wherein the slide unit engages with the part of the endless belt that is flat at the initial position before rotational movement of the endless belt starts, moves following the rotational movement of the endless belt, releases an engagement with the endless belt when reaching the end position and is returned to the initial position by the driving device when the endless belt is at a stop after the engagement is released, and the calculation unit calculates the transfer amount of the recording medium according to the detection result obtained by the linear encoder during a movement of the slide unit reaching the end position from the initial position.

2. The recording medium transfer apparatus of claim 1, further comprising:

a guide axis which extends along a part of the path which is the part of the endless belt that is flat and guides the slide unit, wherein the slide unit contacts with and separates from the endless belt by rotating with respect to the guide axis.

3. The recording medium transfer apparatus of claim 1, wherein the slide unit includes a nub formed on a contact face which contacts with the endless belt.

4. The recording medium transfer apparatus claim 1, wherein the slide unit releases the engagement with the endless belt when the slide unit reaches the end position in a case where the endless belt rotates continuously.

5. The recording medium transfer apparatus claim 1, wherein the slide unit comprises:

a lever member which is pivotally supported so as to rotate freely; and a roller which is pivotally supported at a lower end of the lever member so as to rotate freely, wherein an upper end of the lever member rotates by being pushed by a movable unit of the driving device when the driving device returns the slide unit to the initial position from the end position and makes the slide unit rise by pressing the surface of the endless belt with the roller to release the engagement between the endless belt and the slide unit.

6. The recording medium transfer apparatus claim 1, wherein a movable unit of the driving device includes a cam face which makes the slide unit rise to release the engagement between the endless belt and the slide unit when the driving device returns the slide unit to the initial position from the end position.

7. An image forming apparatus, comprising:

the recording medium transfer apparatus claim 1, and an image forming unit which forms an image on the recording medium which is transferred by the recording medium transfer apparatus.

* * * * *